United States Patent [19]

Nakajima et al.

[11] 4,067,618

[45] Jan. 10, 1978

[54] APPARATUS FOR PROTECTING OF COAL MINE WORKERS

[75] Inventors: Shigeo Nakajima; Ken Takahashi, both of Tokyo; Tsunetoshi Itoh, Yokohama; Hajime Endo, Kushiro, all of Japan

[73] Assignee: Taiheiyo Engineering Inc., Tokyo, Japan

[21] Appl. No.: 726,406

[22] Filed: Sept. 24, 1976

[51] Int. Cl.[2] ..... E21C 35/20

[52] U.S. Cl. ..... 299/31; 61/45 D; 299/43

[58] Field of Search ..... 61/45 D; 299/11, 31-34, 299/43

[56] References Cited

U.S. PATENT DOCUMENTS

| | | | |
|---|---|---|---|
| 3,280,570 | 10/1966 | Pollard | 61/45 D |

FOREIGN PATENT DOCUMENTS

| | | | |
|---|---|---|---|
| 1,232,899 | 1/1967 | Germany | 299/34 |
| 2,310,077 | 9/1973 | Germany | 61/45 D |
| 2,501,555 | 7/1975 | Germany | 61/45 D |

*Primary Examiner*—Dennis L. Taylor

*Attorney, Agent, or Firm*—George B. Oujevolk

[57] ABSTRACT

An apparatus for protecting coal mine workers from flying coal, rocks, coal dust, scattering coal and the like, which are produced as a drum shearer works in a longwall coal face. The apparatus is provided with isolated walls or chambers between iron props installed in the self-advancing supports provided in the longwall coal face by use of fastening members. The isolated wall or chamber is connected with its adjacent wall or chamber by a flexible connecting member.

1 Claim, 2 Drawing Figures

APPARATUS FOR PROTECTING OF COAL MINE WORKERS

BACKGROUND OF THE INVENTION

In longwall mining employing a drum shearer, it has so far been found that a great deal of coal dust is produced on the entire working face when a coal wall is cut or falls.

In order to prevent the production of such coal dust, it has been proposed to sprinkle water on the spot producing such dust from the drum or to reduce the number of rotation of the drum. However, this is not a good solution to the aforesaid problem. In addition, scattering coal including coal dust is also produced when the coal wall is cut. However, there is no equipment for protecting the face of the mine workers from such coal dust and scattering coals, and hence, the workers have been protecting themselves by escaping to the intake air side or hiding under the shade of a machine or a support or the like.

OBJECTS OF THE INVENTION

It is a principal object of the present invention to provide an apparatus for protecting coal mine face workers from flying coal, rocks, coal dust which apparatus is used in a longwall coal face; and which is free from the drawbacks of the present day apparatus.

The present invention provides isolated walls or chambers between the iron props installed in face self-advancing supports or at the conveyor side of the self-advancing supports.

Another object of the invention is to provide an apparatus which ensures an improved working condition in a gate road with high productivity.

These and other objects will be explained in detail hereinafter and are more particularly delineated in the appended claims.

SUMMARY OF THE INVENTION

In summary, the apparatus according to the present invention provides isolated walls or chambers which are polygonal or cylindrical, i.e., round or oval. It is preferred that such cylindrical body be made of ferrous or nonferrous metal, or composite material of metal and rubber, or of metal and synthetic resin, or of metal and synthetic rubber. However, it may be possible to use textures coated on the inner and outer surfaces therof with synthetic resin or synthetic rubber.

Means are provided for connecting the isolated wall or chamber with its adjacent wall or chamber. Such connecting means may preferably be similar in shape to the isolated walls or chambers and preferably be accordion-type hoods with no breaks and with high flexibility. Materials for such accordion-type hoods may be synthetic rubber plates or textures coated on the inner and outer surfaces with synthetic resin or synthetic rubber. It is preferred that a reinforcing member, such as wire, be inserted into the hoods at appropriate distances from each other, so as to add strength to said hoods.

DETAILED DESCRIPTION OF THE INVENTION

Figure 1:
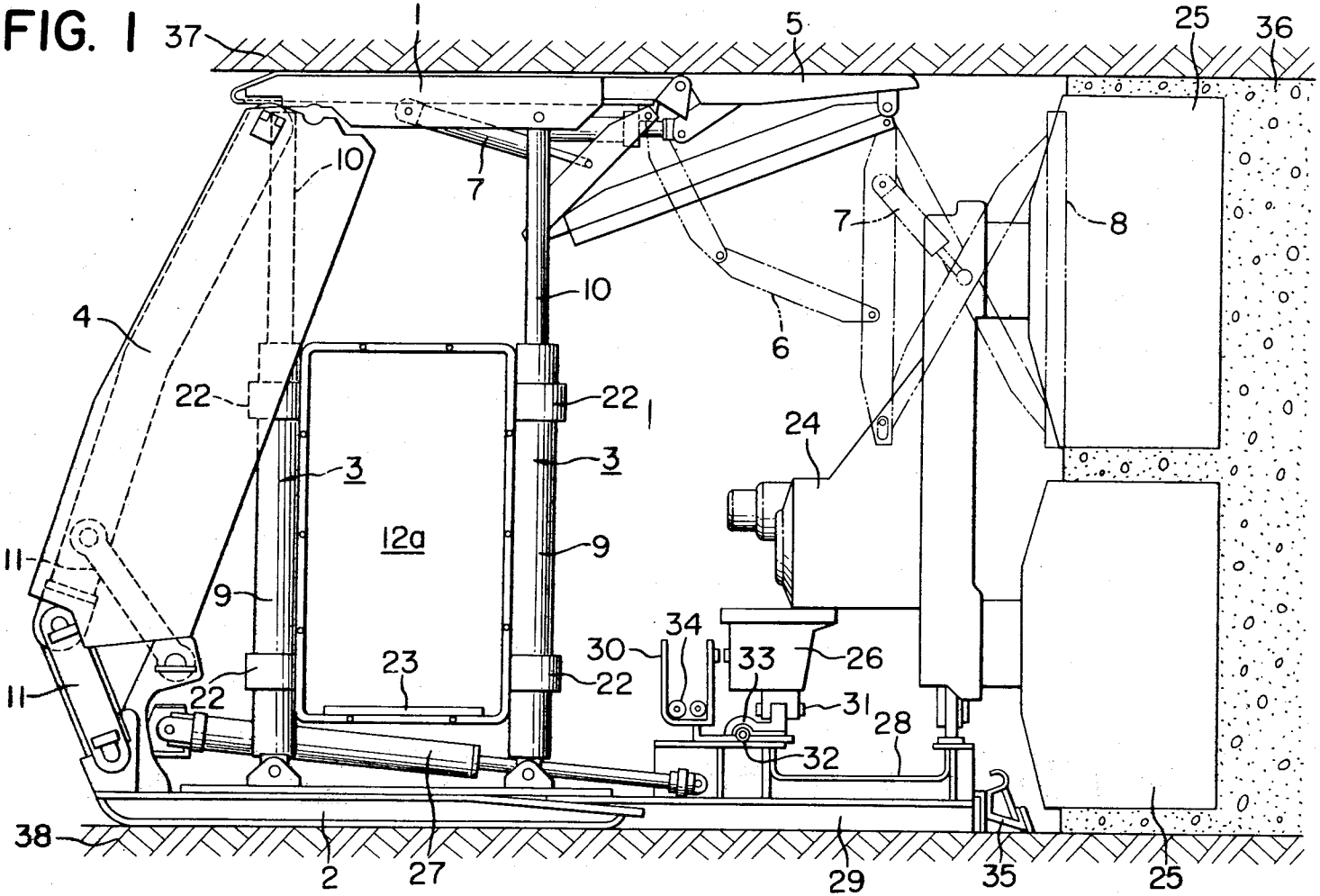
FIG. 1 is a cross-sectional front elevation, partly broken, showing the wall with which the isolated chamber, of the present invention is formed, which is provided between the iron props of the self-advancing support provided with a pantographic wall protector.
Figure 2:
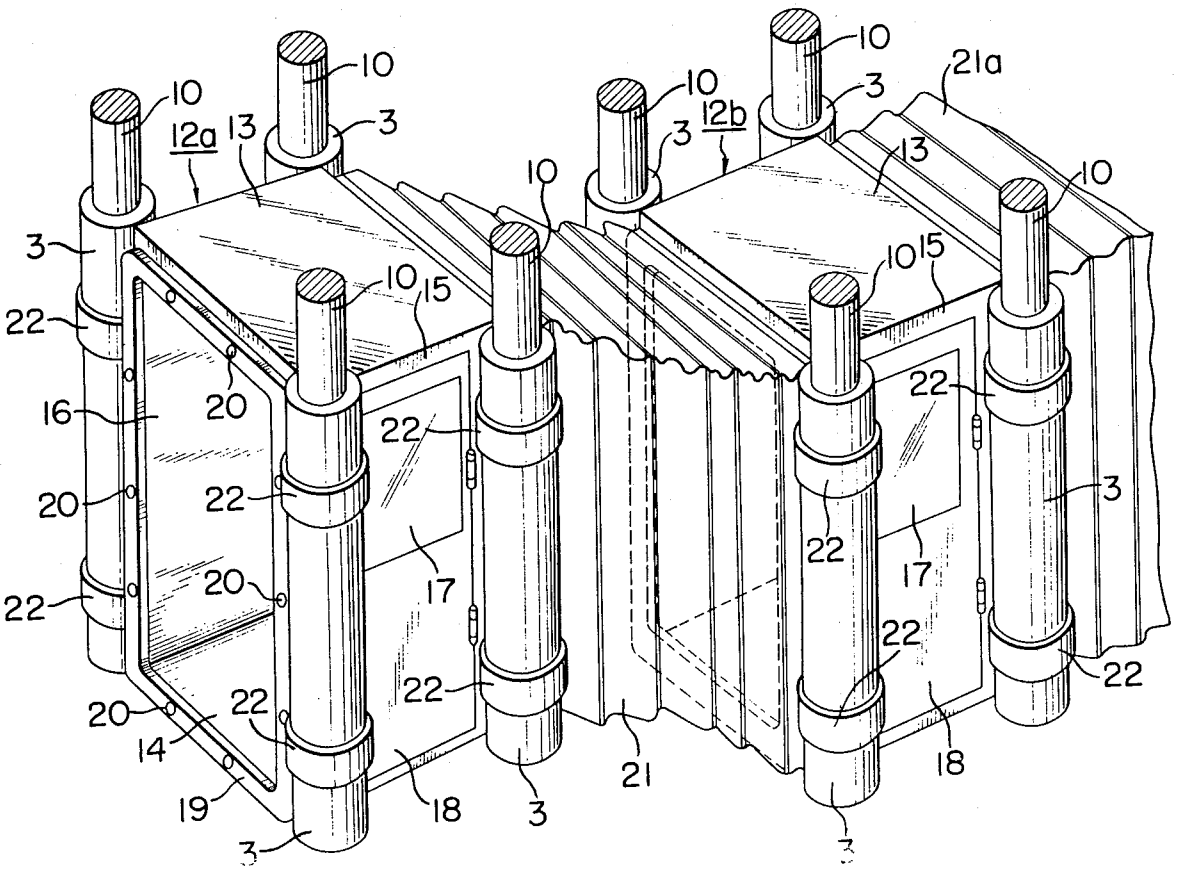
FIG. 2 is a perspective view showing the isolated chambers or the isolated walls of the present invention in application example, which are connected by a flexible connecting member.

As shown in FIG. 1 and FIG. 2, a plural number of iron props 3 (four iron props are used in the embodiment shown) are provided between an upper beam 1 and a skid 2 spaced apart from each other. The upper beam 1 and the skid 2 are rotatably connected at their rear ends to an arch frame 4.

The upper beam 1 is provided with a tip end beam 5, a plurality of link members 6, cylinders 7 and a wall protector plate 8. The wall protector plate 8 is adapted to advance and retreat by the operation of the cylinders 7 through the link members 6, so as to prevent coal from falling off the working face.

The iron prop 3 consists of a hydraulic cylinder 9 and a piston rod 10 which reciprocates in the hydraulic cylinder 9. The hydraulic cylinder 9 is connected at the lower end to the skid 2 by means of a pin, while the piston rod 10 is connected at the upper end to the beam 1 by means of a pin.

The arch frame 4 is connected to its supporting members 11 as well as to the rear end of the upper beam 1. The arch frame 4 is rotatably connected to the piston rod 10 which reciprocates in the hydraulic cylinder 9, the upper beam 1 which enables the self-advancing support to advance, and also to the arch frame supporting members. The front walls 15 with see-through window 17 are preferably the door type 18 made of a steel structure.

The isolated chamber **12*a* in another application of this invention consists of an upper wall 13, a lower wall 14, a front wall 15 and a rear wall 16**, and is provided on the right and left sides with passage entrances.

The isolated chamber **12*a* with the walls 15 and 16 as described is detachably connected to the iron props by means of fastening members, such as bands 22** or snaps.

Flange members 19 are rigidly mounted on the right and left sides of the isolated chamber. The flange members 19 are formed with guide holes 20 thereon. Fastening means (not shown) are attached to said flange members. The isolated chamber **12*a* and its adjacent isolated chamber 12*b* or the walls 15 and 16 are connected by a flexible connecting member, such as an accordion-type hood 21** or accordion-type curtains.

The hood 21 or accordion-type curtain is strong enough for bending which necessarily occurs when the self-advancing support advances (approximately 60 cm) as well as for people to walk thereon. Such hood or accordion-type curtain may be made of a texture coated on the surface with synthetic rubber or the like, or may be made of a plastic sheet or a texture alone. It may sometimes be preferred that a reinforcing member, such as wire, will be inserted into the hood 21 or accordion-type curtain. The hood **21*a* or accordion type curtain is provided on the both edges with projection members (not shown) corresponding to the guide holes 20 provided on the entrance of passage of the isolated chamber 12b adjacent to the isolated chamber 12*a* or the hood or accordion-type curtain 21** so that said hood may be detached easily.

A plurality of the isolated chambers 12*a*, 12*b* in another application. . . are connected by a plurality of the hoods 21*a*, . . . to form a passage therebetween. Flexible sheets 23 suitable for walking are placed on the passage. It is preferred that the sheets 23 be cut into an appropriate length, so that these sheets may be placed and detached with ease.

It is not necessary to connect such sheets with each other, but to place them one on the other. Such flexible sheets are secured to the bottoms of the chambers by means of screws, if necessary.

A drum shearer 24 is provided with double-ranging drum shearers 25. A shoe 33 is connected to the leg of the drum shearer 24 by means of a pin 31. The shoe 33 is slidably mounted on a guide tube 32.

A shift member 27 on the skid 2 is connected at the one end at the self-advancing support side and at the other end at the face conveyor side.

Shown at 28 is the face conveyor. A skid 30 is integrally formed with the face conveyor 28. Defined on the apparatus also is a spill plate 30, cables 34, a coal planer 35, a coal wall 36, a roof 37 and a floor 38.

The isolated chambers or the walls are connected with each other by the flexible connecting members to form a tunnel-like passage between a number of the self-advancing supports provided in parallel at the face side.

A wind fan is provided for supplying fresh air into the passage from the main gate. Therefore, fresh air is supplied into the passage all the time. Also, the air pressure in the passage is kept higher than that in the face, so that the dust produced in the face may not be permitted to enter into the passage. It is also possible to take a lookout for the face side from the chambers through the see-through windows. In case of emergency, face workers are allowed to enter into the isolated chamber through the door.

With the apparatus of the present invention, the self-advancing supports, which advance with a predetermined distance, are connected by the flexible connecting members, thus there is no adverse influence in the working condition in the self-advancing supports.

It is needless to say that various modifications may be made on the walls or the isolated chamber and the connecting member without departing from the scope of the claims of the present invention. For example, an isolated chamber or walls are divided in the upper and lower chambers. The lower chamber being formed into a square, while the upper chamber is formed into a dome shape. The upper chamber is mounted in the lower chamber in such a manner that the upper chamber may move reciprocatively, to thereby prevent the accumulation of dust on the upper chamber.

We claim:

1. An apparatus for protecting mine workers, comprising in combination:

a. an upper horizontal beam (1) with defined front and rear portions;

b. a lower horizontal skid (2) suitably separated from said upper beam (1) with front and rear ends, said rear end being connected to said beam rear portion by an arch frame (4) with telescoping props (3) between said beam (1) and said skid (2);

c. a tip end beam (5) at the front side of said upper beam (1), a vertical wall protector plate (8) and link members (6), and cylinders (7) connecting said wall protector plate (8) and said tip end beam (5), said plate (8) being disposed in front of said tip end beam (5) to hold against a working face, said plate (8) being moveable to and away from said tip end beam (5) so as to prevent mine debris from falling off the working face;

d. drum shearer means (24, 25, 26, 28, 30) disposed at the front end of said skid (2) jack means (27) coupled between said arch frame (4) and said drum shearer means to press said drum shearer means against the working face;

e. a plurality of isolated chambers (12*a*, 12*b*) each with a chamber top disposed between said skid (2) and beam (1) and fastened to said props (3); and, f. an accordion-type hood (21) including reinforcing means between the tops of said chambers to form a protected passage therebetween.

* * * * *